US007348872B1

(12) United States Patent
Parry et al.

(10) Patent No.: US 7,348,872 B1
(45) Date of Patent: Mar. 25, 2008

(54) FUSE HAVING A PLURALITY OF CONFIGURABLE THERMAL CEILINGS

(75) Inventors: Robert N. Parry, Beaver, PA (US); James J. Benke, Pittsburgh, PA (US); Chad A. Eckhardt, Pittsburgh, PA (US); Kenneth W. Sanner, Pittsburgh, PA (US); Jianqiang Zhu, Jiangsu (CN)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/558,677

(22) Filed: Nov. 10, 2006

(51) Int. Cl.
*H01H 85/04* (2006.01)
*H01H 85/143* (2006.01)
*H01H 85/165* (2006.01)

(52) U.S. Cl. ..... 337/229; 337/293; 337/161; 337/228; 337/246

(58) Field of Classification Search ..... 337/293, 337/273, 280, 282, 158–162, 186, 144, 178, 337/256, 268, 271, 284–289, 229
See application file for complete search history.

(56) References Cited

U.S. PATENT DOCUMENTS 1,737,329 A * 11/1929 Patrick ..... 337/289
2,006,837 A * 7/1935 Lefebre ..... 337/256
2,156,058 A * 4/1939 Lohausen ..... 337/229
2,826,660 A * 3/1958 Kozacka ..... 337/161
2,866,037 A * 12/1958 Stewart ..... 337/161
3,194,923 A * 7/1965 Cameron et al. ..... 337/161
3,257,525 A * 6/1966 Gallagher et al. ..... 337/256
3,304,387 A * 2/1967 Lindell ..... 337/162
3,611,239 A * 10/1971 Kozacka ..... 337/151
3,636,491 A * 1/1972 Cameron ..... 337/244
3,721,935 A * 3/1973 Kozacka ..... 337/164
3,777,370 A * 12/1973 Wakui ..... 29/623
3,916,363 A * 10/1975 Jekai ..... 337/191
3,947,798 A * 3/1976 Zankl ..... 337/228
3,949,341 A 4/1976 Cherry
4,035,755 A 7/1977 Cameron
4,057,776 A 11/1977 Blewitt et al.
4,084,145 A 4/1978 Miller
4,114,128 A 9/1978 Cameron
4,121,186 A 10/1978 Santilli
4,166,266 A * 8/1979 Kozacka et al. ..... 337/158
4,179,677 A * 12/1979 Kozacka et al. ..... 337/161
4,272,752 A * 6/1981 Jacobs, Jr. ..... 337/276
4,528,536 A 7/1985 Blewitt et al.
4,544,908 A 10/1985 Blewitt et al.
4,952,900 A 8/1990 Cameron et al.
5,073,839 A * 12/1991 Yallon ..... 361/104
5,714,923 A 2/1998 Shea et al.
5,861,793 A * 1/1999 Hatton ..... 337/229
6,538,550 B1 * 3/2003 Muench et al. ..... 337/161
6,636,409 B2 10/2003 Kladar et al.
6,995,648 B2 2/2006 Jur et al.

* cited by examiner

*Primary Examiner*—Anatoly Vortman
*Assistant Examiner*—Bradley H Thomas
(74) *Attorney, Agent, or Firm*—Martin J. Moran

(57) ABSTRACT

A fuse having a plurality of configurable thermal ceilings. The fuse includes a housing, a first conductive cap, a second conductive cap, a plurality of conductive elements extending through the housing, and a conductive connector that is electrically coupled to a conductive element. One or more conductive elements are electrically connected to the first conductive cap at any one time.

30 Claims, 4 Drawing Sheets

FUSE HAVING A PLURALITY OF CONFIGURABLE THERMAL CEILINGS

BACKGROUND OF THE INVENTION

1. Field of the Invention

The invention relates generally to fuses and, more particularly, to fuses having configurable thermal ceiling.

2. Background Information

A fuse is a type of overcurrent protection device for installation into a power circuit. A fuse has an element (or a plurality of elements), which is typically a metal wire or conductive strip or other conductor, which will melt, sever, or otherwise open when heated by a predetermined electrical current for a predetermined time. Accordingly, fuses are generally designed to allow the flow of an electrical current up to a certain current threshold. Once the current threshold is crossed, the element in the fuse opens, thereby protecting the power circuit from the overcurrent condition. For example, a fuse can be rated to allow a flow of an electrical current up to 30 amperes (A). If an electrical current greater than 30 amperes (i.e., an overcurrent) is applied to the power circuit, then the element in the fuse will open and the circuit will be protected from the overcurrent. Once the element in a fuse opens, the fuse must be replaced with a new fuse so that the power circuit may be reenergized.

Because fuses have the capacity to protect a power circuit up to the particular current threshold, a fuse having a current threshold of 10 amperes will be installed in a power circuit where the current should not exceed 10 amperes, while a fuse having a current threshold of 20 amperes will be installed in a power circuit where the current should not exceed 20 amperes. Storing fuses having different current thresholds, however, can often be cost prohibitive. Moreover, purchasing fuses having different current thresholds can be costly if the current needs of a power circuit changes. Accordingly, there is a need for a fuse that can reduce the costs associated with storing and utilizing the fuse.

SUMMARY OF THE INVENTION

This need, and others, is met by embodiments of the invention which provide a fuse having a plurality of configurable thermal ceilings.

In accordance with one embodiment of the invention, an electrical fuse comprising: a housing having a first end, a second end, and a channel extending therethrough; a first conductive cap having a surface, the first conductive cap being secured to the first end of the housing; a second conductive cap secured to the second end of the housing; a plurality of conductive elements having a first end located substantially adjacent to the first end of the housing and a second end electrically connected to the second conductive cap, the conductive elements extending through the channel, at least one of the conductive elements having a thermal ceiling that is different from a thermal ceiling of another one of the conductive elements; and a conductive connector coupled to the first end of each of the conductive elements, at least one of the conductive connectors being electrically connected to the first conductive cap at one time.

In accordance with another embodiment of the invention, an electrical fuse comprising: a housing having an axis, a first end, a second end, and a channel extending therethrough, the channel being parallel or substantially parallel to the axis; a first conductive cap having a surface and a plurality of apertures disposed on the surface thereof, the first conductive cap being secured to the first end of the housing; a second conductive cap secured to the second end of the housing; a plurality of conductive elements having a first end located substantially adjacent to the first end of the housing and a second end electrically connected to the second conductive cap, the conductive elements extending through the channel, at least one of the conductive elements having a thermal ceiling that is different from a thermal ceiling of another one of the conductive elements; a conductive connector coupled to the first end of each of the conductive elements; and a conductive mechanical fastener extending through at least one of the apertures, the conductive mechanical fastener being electrically connected to the conductive connector of one of the conductive elements as well as to the first conductive cap.

In accordance with yet another embodiment of the invention, an electrical fuse comprising: a housing having a first end, a second end, and a channel extending therethrough; a first conductive cap having a surface, the first conductive cap being secured to the first end of the housing; a second conductive cap secured to the second end of the housing; a plurality of conductive elements having a first end located substantially adjacent to the first end of the housing and a second end electrically connected to the second conductive cap, the conductive elements extending through the channel, each of the conductive elements having substantially the same thermal ceiling; and a conductive connector coupled to the first end of each of the conductive elements, a number of the conductive connectors being electrically connected to the first conductive cap at one time.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
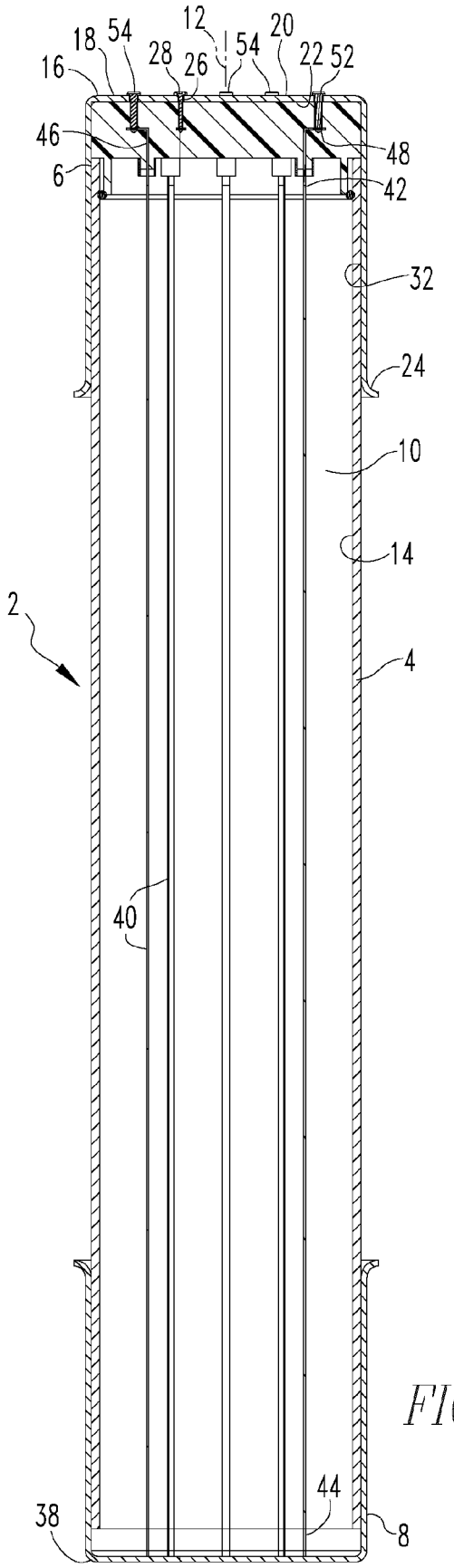
FIG. 1 is a cross-sectional view of an electrical fuse in accordance with an embodiment of the invention.
Figure 4:
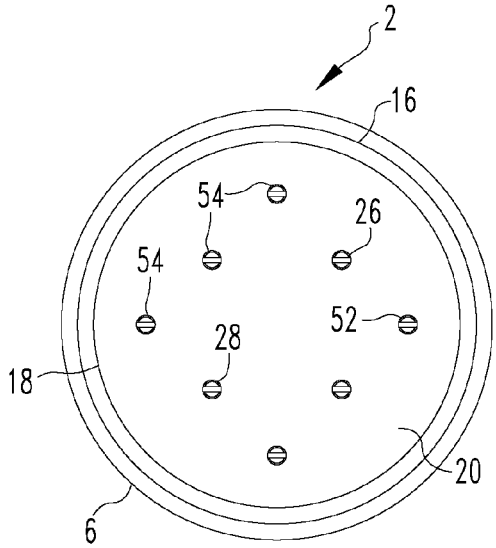
FIG. 4 is a top plan view of the end of the electrical fuse of FIG. 2.
Figure 2:
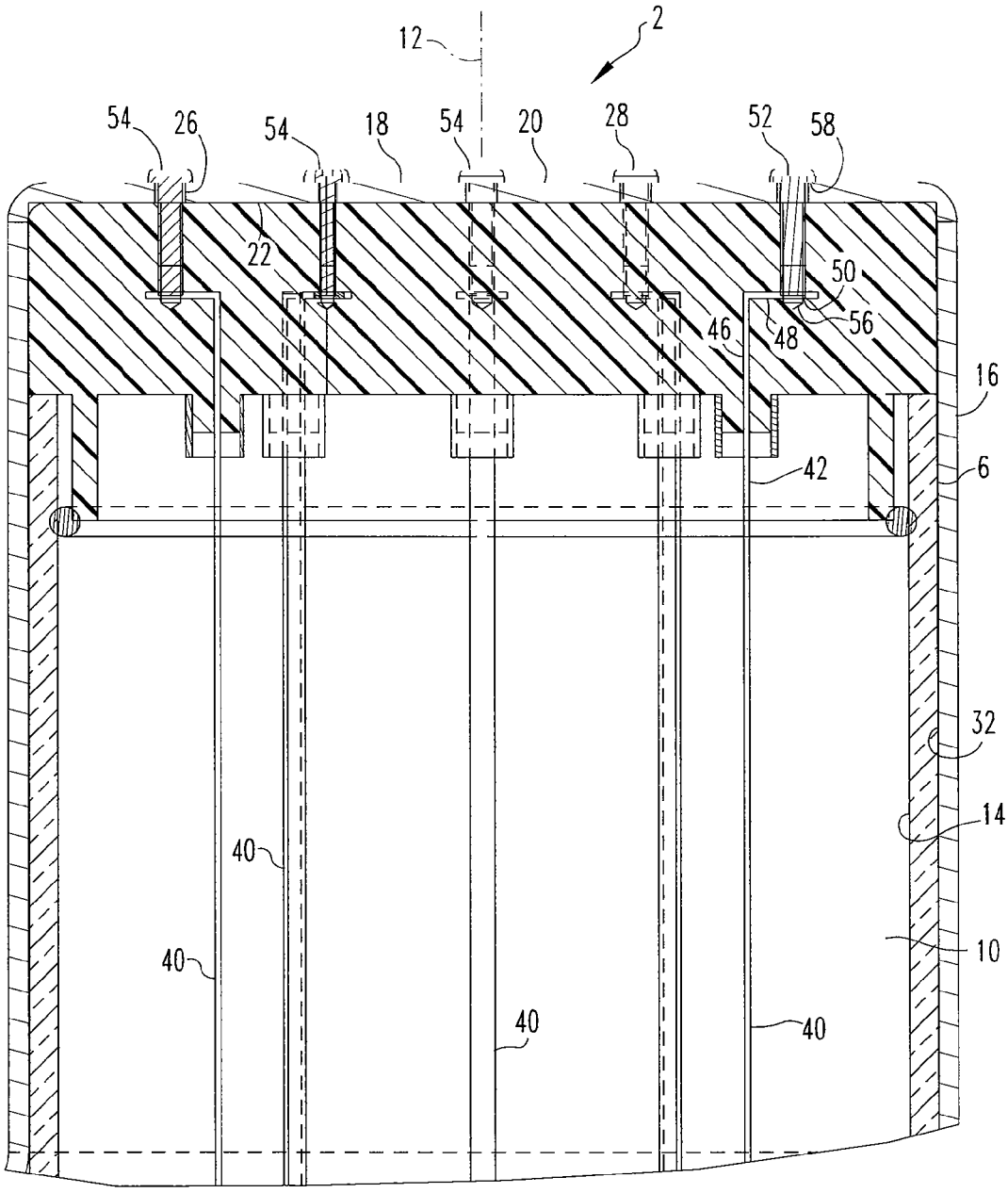
FIG. 2 is a cross-sectional view of one end of the electrical fuse of FIG. 1.

As employed herein, the term "mechanical fastener" or variations thereof shall refer broadly to any suitable fastening, connecting or tightening mechanism including, but not limited to, screws, bolts, and the combination of bolts and nuts.

As employed herein, the term "thermal ceiling" or variations thereof refers to the "current rating" of an electrical fuse, or the electrical current threshold that an element of an electrical fuse can sustain before the element opens.

As employed herein, the term "number" means one or an integer greater than one (i.e., a plurality).

Directional phrases used herein, such as, for example, upper, lower, left, right, vertical, horizontal, top, bottom, above, beneath, clockwise, counterclockwise and derivatives thereof, relate to the orientation of the elements shown in the drawings and are not limiting upon the claims unless expressly recited therein.

When referring to any numerical range of values, such range is understood to include each and every number and/or "rational number" or "irrational number" between the stated range minimum and maximum.

Figure 3:
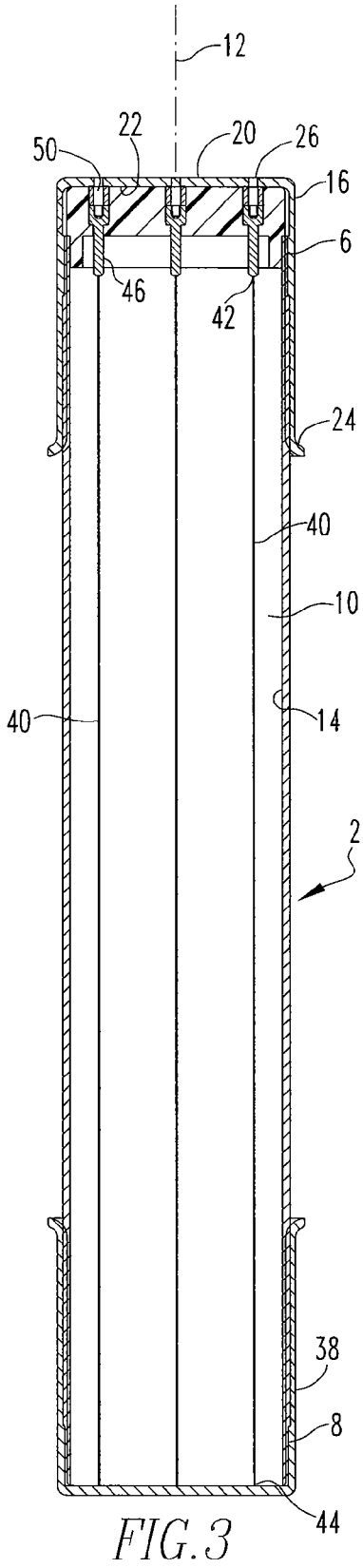
FIG. 3 is a cross sectional view of an electrical fuse in accordance with another embodiment of the invention.
Figure 3A:
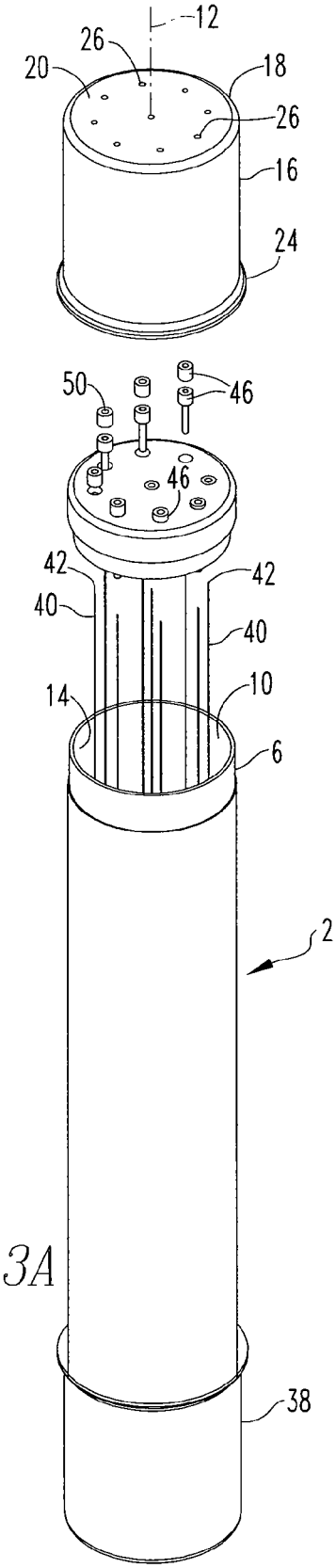
FIG. 3A is an exploded view of the electrical fuse of FIG. 3.

Referring to FIGS. 1-4, a fuse 2 has a housing 4 that has a first end 6, a second end 8, and a channel 10 that extends through the housing 4 in a direction substantially parallel to an axis 12 of the housing 4. In one embodiment of the invention, the housing 4 is an elongated housing 4. As can be seen, the channel 10 is defined by the interior surface 14 of the housing 4. Adjacent to the first end 6 of the housing 4 is a first conductive cap 16 that has a first end 18, which has a first surface 20 and a second surface 22, and a second end 24 (FIG. 1). Disposed on the first surface 20 of the first conductive cap 16 is a plurality of apertures 26. Each aperture 26 is adapted to receive a mechanical fastener 28 that, as will be discussed in greater detail below, allows the fuse 2 to be utilized in an electrical circuit (not shown). In one embodiment of the invention, an O-ring (not shown) is disposed on an interior surface 32 of the first conductive cap 16 substantially adjacent to the second end 24 of the first conductive cap 16. Continuing to refer to FIGS. 1, 3, and 3A, located adjacent to the second end 8 of the housing 4 is a second conductive cap 38. In one embodiment of the invention, the first and the second conductive caps 16,38 are manufactured from a conductive metal, such as copper, or a conductive metal alloy.

A plurality of conductive elements 40 extend through the channel 10 of the housing 4 in a direction that is substantially parallel to the axis 12 of the housing 4. As can be seen from FIGS. 1 and 3, each conductive element 40 has a first end 42 that is positioned adjacent to the first end 6 of the housing 4 and a second end 44 that is in contact with and electrically connected to the second conductive cap 38 that is located at the second end 8 of the housing 4. Disposed at the first end 42 of each element 40 is a conductive connector 46, which in the embodiment depicted in FIG. 2, has a substantially L-shape. The portion 48 of the conductive connector 46 that is substantially perpendicular to the axis 12 of the housing 4 (hereinafter, referred to as the first end 48) has an aperture 50 that is adapted to receive a mechanical fastener, such as 28, that extends through the aperture 26 disposed on the first surface 20 of the first conductive cap 16. It should be noted, however, that in another embodiment of the invention, the conductive connector 46 does not have a first end 48 that extends substantially perpendicular to the axis 12 of the housing 4. Rather, the conductive connector 46 has a substantially cylindrical shape and an aperture 50, which corresponds to an aperture 26 disposed on the first conductive cap 16, for receiving the mechanical fastener 28 (see FIG. 3). The conductive connectors 46 are typically welded or soldered onto the first end 42 of each element 40. In one embodiment of the invention, a surface of each conductive connector 46 is covered with an insulating material.

Referring to FIGS. 1-4, as stated above, the apertures 26 that are disposed on the first surface 20 of the first conductive cap 16 are structured to receive a mechanical fastener 28. As will be explained in greater detail below, depending on the number of elements 40 in the fuse 2, the mechanical fasteners 28 that are extended through the apertures 26 that are disposed on the first conductive cap 16 are typically a combination of one electrically conductive mechanical fastener 52 and a plurality of non-conductive mechanical fasteners 54. It is noted, however, that in other embodiments of the invention more than one electrically conductive mechanical fastener 52 may be used as well. The conductive mechanical fastener 52 can be made from a suitable conductive metal, such as copper, or a conductive metal alloy while the non-conductive mechanical fasteners 54 are typically made of a suitable insulator, such as nylon.

Referring to FIGS. 1-3A, when the conductive mechanical fastener 52 is inserted into one of the apertures 26 disposed on the first conductive cap 16, a first end 56 of the conductive mechanical fastener 52 will be received into the aperture 50 of the conductive connector 46. Once the conductive mechanical fastener 52 has been received into the aperture 50 of the conductive mechanical fastener 52 will be in contact with and, therefore, electrically connected to the conductive connector 46. Accordingly, the conductive mechanical fastener 52 will also be electrically connected to the conductive element 40 that is electrically connected to the conductive connector 46. Because a second end 58 of the conductive mechanical fastener 52 will be in contact with the first surface of the first conductive cap 16, the first conductive cap 16 will be electrically connected to the conductive element 40 to which the conductive mechanical fastener 52 is electrically connected to, thereby electrically connecting the first conductive cap 16 to the second conductive cap 38 through the conductive element 40. With this configuration, the fuse 2 is in condition to be utilized in an electrical circuit. In one embodiment of the invention, the conductive mechanical fastener 52 is threaded into the aperture 50 of the conductive connector 46.

In order to ensure that only a particular conductive element 40 (or a plurality of elements 40) in the fuse 2 is being used at any one time, non-conductive mechanical fasteners 54 will be inserted into the apertures 26 disposed on the first conductive cap 16 that are associated with the conductive elements 40 that are not for electrical current use. Because the non-conductive mechanical fastener 54 is made from a non-conductive material, the first and second conductive caps 16,38 will not be electrically connected through the conductive elements 40 whose conductive connectors 46 are in contact with the non-conductive mechanical fasteners 54. Additionally, an insulating material, such as an epoxy, can be positioned adjacent to the second surface 22 of the first conductive cap 16 in order to insulate the elements 40 that are electrically connected to the first and second conductive caps 16,38 (active elements) from the elements 40 that are not electrically connected to the first and second conductive caps 16,38 (inactive elements).

Figure 5:
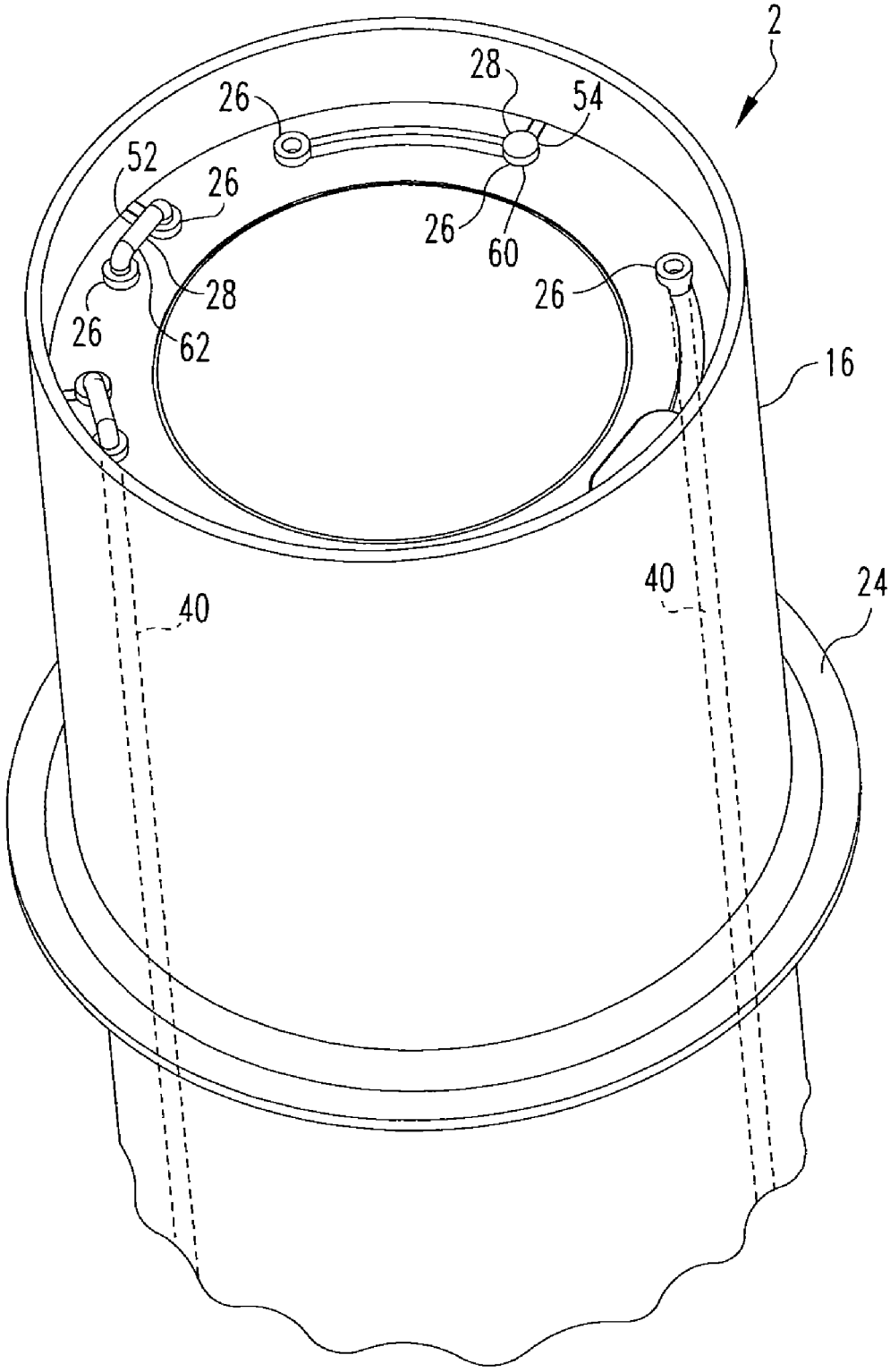
FIG. 5 is an isometric view of the end of an electrical fuse illustrating an alternate method of connecting the elements in the fuse to the first conductive cap.

Referring to FIG. 5, in this figure the mechanical fasteners 28 are shown having two different configurations. In the first configuration 60, the mechanical fastener 28 is comprised of a single extending portion that is received into an aperture 26 disposed on the first conductive cap 16. In the second configuration 62, the mechanical fastener 28 is comprised of a number of extending portions wherein each extending portion is received into an aperture 26 disposed on the first conductive cap 16.

EXAMPLE 1

In one embodiment of the invention, each conductive element 40 in the fuse 2 has a thermal ceiling that is different from the thermal ceiling of the other conductive elements 40 in the fuse 2. For example, the fuse 2 can have a first conductive element 40 that has a thermal ceiling of about 5 amperes, a second conductive element 40 that has a thermal ceiling of about 10 amperes, and a third conductive element 40 that has a thermal ceiling of about 15 amperes. Therefore, with proper selection of the non-conductive mechanical fastener 54 and the conductive mechanical fastener 52, one fuse 2 can be installed in electrical circuits that require protection against overcurrent conditions where the electrical current exceeds 5 amperes, 10 amperes or 15 amperes, respectively.

EXAMPLE 2

In another embodiment of the invention, each conductive element 40 in the fuse 2 has a thermal ceiling that is the same as the thermal ceiling of all of the other conductive elements 40 in the fuse 2. Because each conductive element 40 has the same thermal ceiling, the fuse 2 can still be used in an electrical circuit even though one of the conductive elements 40 has been opened due to an overcurrent condition. For example, if an electrical circuit requires protection against overcurrent conditions where the electrical current exceeds about 10 amperes, then a fuse 2 having a plurality of conductive elements 40, wherein each conductive element 40 has a thermal ceiling of about 10 amperes, can be installed into the electrical circuit. When one conductive element is opened due to an electrical current that exceeds about 10 amperes, the fuse 2 can still be used in the electrical circuit by relocating the conductive mechanical fastener 52 to another aperture 26 disposed on the first conductive cap 16 that is associated with another conductive element 40 that has not been opened.

EXAMPLE 3

In yet another embodiment of the invention, at least one conductive element 40 has a thermal ceiling that is different from the thermal ceiling of the other conductive elements 40 in the fuse 2. For example, one conductive element 40 can have a thermal ceiling of about 5 amperes (kV) while two other conductive elements 40 can have a thermal ceiling of about 15 amperes. If the circuit in which the fuse 2 is going to be installed requires that the electrical current not exceed about 5 amperes, then the conductive mechanical fastener 52 will be inserted into the aperture 26 disposed on the first conductive cap 16 that is associated with the about 5 amperes conductive element 40 while non-conductive mechanical fasteners 54 are inserted into the apertures 26 on the first conductive cap 16 that are associated with the about 15 amperes conductive elements 40.

Because the disclosed fuse 2 contains a plurality of conductive elements 40, which can have different thermal ceilings, the total number of fuses 2 that are stored in a storage facility can be dramatically decreased since a single fuse 2 can potentially be used in different electrical circuits having different electrical current needs. Moreover, unlike traditional fuse designs, which require the fuse to be discarded and replaced after every overcurrent condition, the disclosed fuse 2 does not have to be discarded or replaced after each overcurrent condition if the fuse 2 has a plurality of conductive elements 40 with the same thermal ceiling. Accordingly, the total number of fuses stored in a storage facility can be decreased since the fuses 2 do not have to be replaced after being exposed to a number of overcurrent conditions.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An electrical fuse comprising:

a housing having a first end, a second end, and a channel extending therethrough;

a first conductive cap having a surface and a plurality of apertures disposed on said surface, said first conductive cap being secured to said first end of said housing;

a second conductive cap secured to said second end of said housing;

a plurality of conductive elements having a first end located substantially adjacent to said first end of said housing and a second end electrically connected to said second conductive cap, said conductive elements extending through said channel, at least one of said conductive elements having a thermal ceiling that is different from a thermal ceiling of another one of said conductive elements;

a conductive connector coupled to said first end of each of said conductive elements, a number of said conductive connectors being electrically connected to said first conductive cap at one time;

a conductive mechanical fastener extending through one of said apertures and being electrically connected to said conductive connector of one of said conductive elements as well as to said first conductive cap; and a non-conductive mechanical fastener extending through another one of said apertures and being mechanically connected to said conductive connector of another one of said conductive elements as well as to said first conductive cap.

2. The electrical fuse according to claim 1, wherein each of said conductive elements has a different thermal ceiling.

3. The electrical fuse according to claim 1, wherein at least some of said conductive elements have the same thermal ceiling.

4. The electrical fuse according to claim 1, wherein each of said first and second conductive caps are made from a conductive metal or a conductive metal alloy.

5. The electrical fuse according to claim 4, wherein said conductive metal is copper.

6. The electrical fuse according to claim 1, wherein said thermal ceiling of said conductive elements ranges from about 10 amperes to about 70 amperes.

7. The electrical fuse according to claim 1, wherein said conductive mechanical fastener is made from a conductive metal or a conductive metal alloy.

8. The electrical fuse according to claim 7, wherein said conductive metal is copper.

9. The electrical fuse according to claim 1, wherein said non-conductive mechanical fastener is made of nylon.

10. The electrical fuse according to claim 1, wherein said conductive connector of each of said conductive elements includes a surface having an epoxy material disposed thereon.

11. The electrical fuse according to claim 1, wherein said housing further has an axis, and said channel extends parallel or substantially parallel to said axis.

12. The electrical fuse according to claim 1, wherein the surface of said first conductive cap has an external portion distal from the channel of said housing and an opposite internal portion facing the channel of said housing; and wherein said non-conductive mechanical fastener engages the external portion of said first conductive cap and extends completely through said another one of said apertures from said external portion to said internal portion.

13. An electrical fuse comprising:

a housing having an axis, a first end, a second end, and a channel extending therethrough, said channel being parallel or substantially parallel to said axis;

a first conductive cap having a surface and a plurality of apertures disposed on said surface thereof, said first conductive cap being secured to said first end of said housing;

a second conductive cap secured to said second end of said housing;

a plurality of conductive elements having a first end located substantially adjacent to said first end of said housing and a second end electrically connected to said second conductive cap, said conductive elements extending through said channel, at least one of said conductive elements having a thermal ceiling that is different from a thermal ceiling of another one of said conductive elements;

a conductive connector coupled to said first end of each of said conductive elements;

a conductive mechanical fastener extending through one of said apertures, said conductive mechanical fastener being electrically connected to said conductive connector of one of said conductive elements as well as to said first conductive cap; and a non-conductive mechanical fastener extending through another one of said apertures, said non-conductive mechanical fastener being mechanically connected to said conductive connector of another one of said conductive elements as well as to said first conductive cap.

14. The electrical fuse according to claim 13, wherein each of said conductive elements has a different thermal ceiling.

15. The electrical fuse according to claim 13, wherein at least some of said conductive elements have the same thermal ceiling.

16. The electrical fuse according to claim 13, wherein each of said first and second conductive caps are made from a conductive metal or a conductive metal alloy.

17. The electrical fuse according to claim 13, wherein said conductive mechanical fastener is made from a conductive metal or a conductive metal alloy.

18. The electrical fuse according to claim 13, wherein said non-conductive mechanical fastener is made of nylon.

19. The electrical fuse according to claim 13, wherein said thermal ceiling of said conductive elements ranges from about 10 amperes to about 70 amperes.

20. The electrical fuse according to claim 13, wherein said conductive connector of each of said conductive elements includes a surface having an epoxy material disposed thereon.

21. The electrical fuse according to claim 13, wherein the surface of said first conductive cap has an external portion distal from the channel of said housing and an opposite internal portion facing the channel of said housing; and wherein said non-conductive mechanical fastener engages the external portion of said first conductive cap and extends completely through said another one of said apertures from said external portion to said internal portion.

22. An electrical fuse comprising:

a housing having a first end, a second end, and a channel extending therethrough;

a first conductive cap having a surface and a plurality of apertures disposed on said surface, said first conductive cap being secured to said first end of said housing;

a second conductive cap secured to said second end of said housing;

a plurality of conductive elements having a first end located substantially adjacent to said first end of said housing and a second end electrically connected to said second conductive cap, said conductive elements extending through said channel, each of said conductive elements having substantially the same thermal ceiling;

a conductive connector coupled to said first end of each of said conductive elements, a number of said conductive connectors being electrically connected to said first conductive cap at one time;

a conductive mechanical fastener extending through one of said apertures and being electrically connected to said conductive connector of one of said conductive elements as well as to said first conductive cap; and a non-conductive mechanical fastener extending through another one of said apertures and being mechanically connected to said conductive connector of another one of said conductive elements as well as to said first conductive cap.

23. The electrical fuse according to claim 22, wherein each of said first and second conductive caps are made from a conductive metal or a conductive metal alloy.

24. The electrical fuse according to claim 23, wherein said conductive metal is copper.

25. The electrical fuse according to claim 23, wherein said conductive connector of each of said conductive elements includes a surface having an epoxy material disposed thereon.

26. The electrical fuse according to claim 22, wherein said thermal ceiling of said conductive elements ranges from about 10 amperes to about 70 amperes.

27. The electrical fuse according to claim 22, wherein said conductive mechanical fastener is made from a conductive metal or a conductive metal alloy.

28. The electrical fuse according to claim 27, wherein said conductive metal is copper.

29. The electrical fuse according to claim 22, wherein said non-conductive mechanical fastener is made of nylon.

30. The electrical fuse according to claim 22, wherein the surface of said first conductive cap has an external portion distal from the channel of said housing and an opposite internal portion facing the channel of said housing; and wherein said non-conductive mechanical fastener engages the external portion of said first conductive cap and extends completely through said another one of said apertures from said external portion to said internal portion.

* * * * *